US005964672A

United States Patent [19]

Bianchi

[11] Patent Number: 5,964,672

[45] Date of Patent: Oct. 12, 1999

[54] VIBRATION DAMPER

[76] Inventor: Jean-Claude Bianchi, 617, Les Cabots, 06410 Biot, France

[21] Appl. No.: 09/009,493

[22] Filed: Jan. 20, 1998

[51] Int. Cl.[6] ..... A63B 49/00

[52] U.S. Cl. ..... 473/521; 473/520

[58] Field of Search ..... 473/520, 521, 473/549, 298, 299, 523; 81/22, 489

[56] References Cited

U.S. PATENT DOCUMENTS

| | | | |
|---|---|---|---|
| 1,931,425 | 10/1933 | Barrett | 473/298 |
| 3,941,380 | 3/1976 | Lacoste | 473/520 |
| 4,082,273 | 4/1978 | Ellzey | 473/523 |
| 4,353,551 | 10/1982 | Arieh et al. . | |
| 4,811,947 | 3/1989 | Takatsuka et al. | 473/523 |
| 5,054,780 | 10/1991 | Chen . | |
| 5,083,777 | 1/1992 | Held . | |
| 5,362,046 | 11/1994 | Sims | 473/523 X |
| 5,605,327 | 2/1997 | McCutchen | 473/549 X |
| 5,655,980 | 8/1997 | Nashif et al. | 473/520 |
| 5,772,541 | 6/1998 | Buiatti | 473/521 X |

FOREIGN PATENT DOCUMENTS

| | | | |
|---|---|---|---|
| 299567 | 1/1989 | European Pat. Off. | 473/FOR 183 |
| 4263876 | 9/1992 | Japan . | |
| 1432668 | 4/1976 | United Kingdom . | |

*Primary Examiner*—Raleigh W. Chiu
*Attorney, Agent, or Firm*—Duane, Morris & Heckscher LLP

[57] ABSTRACT

A vibration damper device for a sports striking instrument having a striking surface and a handle, the device being mounted on the free end of the instrument handle in the vicinity of a vibration antinode and comprising an oscillating mass, in which the oscillating mass is included in a cavity of a flexible cap surrounding the end of the handle, said mass being at a distance from said end.

13 Claims, 2 Drawing Sheets

VIBRATION DAMPER

The present invention relates to a vibration damper device, preferably for a racket for tennis or other ball game, a golf club, or a baseball bat, the device being placed on the handle of the instrument and being designed to absorb the vibration imparted by striking the ball.

BACKGROUND OF THE INVENTION

It is well known that an oscillating element set into motion by the vibration produced on striking the ball, e.g. against the stringing of a tennis racket has the effect of attenuating vibration thereof. The oscillating element or device is preferably placed in the vicinity of a vibration antinode of the racket. The self-damped oscillating device picks up the vibration and is set into motion, thereby releasing vibrational energy. However, in addition to the fact that they need to be included in the instrument during manufacture, such devices present a projecting oscillating portion that can impede the handling of said instrument by the player. When the handle of the instrument is hollow, it is indeed possible to place the oscillating device inside the handle, but in that case its travel is limited by the inside diameter of the handle, thereby limiting its effectiveness. No presently known device completely absorbs the vibration of a ball-game instrument without also having a projection that can hinder the hand of the player during play.

OBJECT AND BRIEF SUMMARY OF THE INVENTION

The present invention seeks to remedy several of those drawbacks.

The antivibration device of the invention is constituted by a hollow element of deformable material engaged or fixed on the handle of a ball-game instrument. The deformable element includes a portion constituted by a swelling of material protecting another portion that is more flexible and that oscillates under the effect of vibration transmitted thereto when a ball strikes against the instrument. The motion of the oscillating portion releases the vibrational energy of the instrument, and is itself intrinsically self-damped by the viscoelastic nature of said oscillating element.

In a first embodiment, the device of elastomer material is integrated in the handle of a ball-game instrument. The outer end surface of the cap possesses on its periphery a projection of flexible material extending perpendicularly to the axis of the handle. This projection is thus in the form of a ring protecting the oscillating portion of the device which is situated in the center of the end wall of the cap, on the outside. This oscillation portion is constituted by a flyweight integrally molded with the outside of the end wall of the cap or else is applied thereto and is secured by adhesive or any other presently known means on said outside of the end wall of the cap. The oscillating portion can also be constituted by a hollow outer central indentation of the end wall of the cap. In order to avoid striking the protective ring during such oscillation, the indentation is preferably conical in shape. The center of the indentation may include a cavity. Thus, a mass of greater or lesser density is inserted into the cavity to modify the amplitude of the motion of the oscillating portion. An opening provided through the wall of the indentation makes it possible to reduce the stiffness of the oscillating portion, to make it more flexible, so as to match the energy-dissipating oscillations thereof on the vibrations that need to be attenuated. A variant has a cap whose end wall includes a central opening in which a second cap is engaged, with the end wall thereof passing through the orifice of the first cap and being directed towards the outside. The second cap includes a ring on the outer perimeter of its orifice, which ring serves as a stand whose outer perimeter is greater than the perimeter of the central opening in the first cap. This peripheral ring of the second cap is assembled with and then wedged between the end of the instrument and the remaining inner end wall of the first cap, thereby ensuring that the oscillating element is held properly.

The device of the invention has the advantage of being capable of being molded as a single piece, at least for the portion thereof which is fixed on the instrument and the ring-shaped portion protecting the oscillator. The device is made as a one-piece molding of flexible or semi-rigid thermosetting or thermoplastic material. It can also be manufactured by combining a flexible elastomer portion for surrounding a portion of the handle of the ball-game instrument and an oscillating portion of material that is more rigid. It can also be made of synthetic foam, as a plurality of parts, or partially out of metal.

The present invention is particularly intended for effectively absorbing the vibration of any ball-game instrument by being positioned on any handle without impeding the player in handling the instrument. With the antivibration device of the invention, the hand of the player does not encounter an oscillating or projecting portion that could give rise to injury. Similarly, the feel imparted by holding the handle of the instrument is not degraded and the hand can be positioned on the protective ring of the oscillator.

Also, this ring is made of a material that is slightly flexible and can even provide a comfortable grip for the hand when the player takes hold of the end of the handle of the instrument.

The antivibration device of the invention for a ball game racket frame is constituted by an element of deformable material oscillating under the effect of the vibration transmitted thereto when a ball strikes the stringing of the racket, and the vibration is intrinsically self-damped by said oscillating element which is faired so as to slide over the clothing of the player in the event of making contact therewith. On at least a portion of its outside face, the oscillator therefore presents a surface that is uniform, substantially rounded, spherical or hemispherical or indeed plane or curved with rounded corners. In the preferred first embodiment, the removable self-holding device of elastomer material is in the form of a cap having an opening into which the handle of a tennis racket is engaged by a certain amount. A gap is left between the end of the handle of the racket and the closed inner end wall of the cap. The portion of the cap surrounding the handle is very thin to avoid excessively increasing the diameter of the handle. The diameter of the opening of the cap is substantially smaller than the diameter of the handle of the racket so as to hold the device securely on the racket. When the ball strikes the stringing of the racket vibration is generated at various frequencies. There is high frequency vibration, above 500 Hz, generated by the strings, and low frequency vibration, below 500 Hz, carrying a large amount of energy and generated by deformation of the frame. This energy propagates into the handle and sets into motion the non-engaged portion of the cap which is thus free and particularly deformable and which oscillates in multidimensional manner. This oscillation dissipating the vibrational energy of the racket frame is intrinsically self-damped by the damping nature of the deformable material constituting the oscillating element. The closed portion of the cap can have its mass increased by increasing the thickness of the material from which it is made. It may also be increased by a projection of material projecting from the inside of the end wall of the cap and preferably directed into the empty gap between the end of the racket handle and the inside of the end wall of the cap. This increase in mass increases the amplitude of motion of the oscillator-forming moving portion of the cap. To match the frequency of the oscillator exactly with the vibrational frequency of the racket that is to be damped, it suffices to engage the cap a little more or a little less on the end of the racket handle. The larger the gap between the end wall of the cap and the end of the racket handle, the more flexible the oscillating portion, and vice versa. These different degrees of flexibility associated with different distances between the end of the handle and the inside of the end wall of the cap make it possible to obtain different frequencies for the oscillator, and to obtain a frequency that is best suited for dissipating vibration of each type of racket. Thus, the removable oscillator mounted on a racket is fully integrated with the racket, is aerodynamically shaped to avoid braking penetration of the racket into the air during play, and its faired shape will not catch on the player's clothing. In a variant, the end wall of the cap includes a cavity, which cavity is preferably partially spherical and open either to the inside of the cap or to the outside. This cavity can then receive an appropriate interchangeable element of differing shape, mass, or density, whereby the inertia brought into play when a ball strikes the stringing can be modified, thereby increasing or reducing the frequency or the amplitude of the motion of the oscillator to cause said motion to be in-phase with the vibration that is to be damped. In all cases, at least one opening is formed in the oscillating portion of the cap to allow the air to escape which would otherwise be enclosed when the end of the handle of the racket is inserted in the cap. The cap may also include a slight projection over all or a portion of its inside perimeter, serving as an abutment against further insertion of the end of the racket handle into the cap. Another variant of the invention has a cap provided with a separate faired oscillator, with the substantially flat inner end wall of the cap then coming into contact with the end of the handle of the racket. This cap includes an oscillating device comprising a flyweight constituted by an elongate portion going from the outside of the flat end wall and pointing outwards along the central axis of the racket. The outside endpiece of the oscillating elongate portion that is not held in the device presents a spherical, hemispherical, or rounded faired portion suitable for sliding over the clothing of the player. The endpiece may also have an extension in the form of a rounded cap whose opening is directed towards the flat outer end wall of the other cap surrounding the handle of the racket. The fairing may also be constituted by at least one add-on piece, possibly having the shape of a washer that is directly molded with the elongate portion of the oscillator and that is perpendicular thereto. This washer interposed between the flat outer end wall of the cap surrounding the handle and the elongate outside endpiece of the oscillator may also be constituted by an add-on piece of synthetic foam. In this way, the damper assembly constitutes a uniform faired assembly that does not catch on the clothing of the player.

BRIEF DESCRIPTION OF THE DRAWINGS

Other characteristics and advantages of the invention appear from the following description of particular embodiments given as non-limiting examples with reference to the figures, in which.

MORE DETAILED DESCRIPTION

Figure 1:
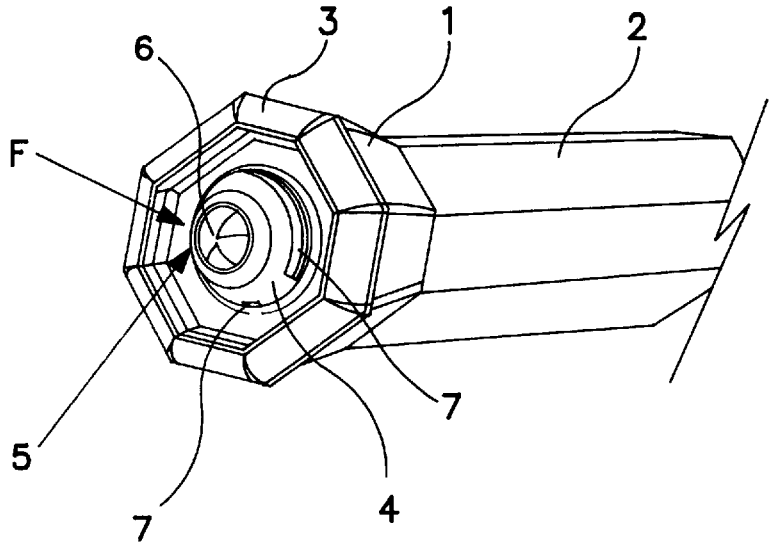
FIG. 1 shows a device integrated with the handle of a tennis racket.

FIG. 1 is a perspective view showing a device of the invention positioned on the handle of a tennis racket. It comprises a cap 1 that is octagonal in this case and positioned around the handle 2 of a tennis racket. The cap includes a protective ring 3 that is integrally molded therewith. The protective ring is made out of a material that is not very flexible, thereby improving the grip of the player's hand on the instrument. A projection 4 inside the ring is also integrally molded with the center of the end wall F of the cap, on the outside, and constitutes the oscillating portion of the device. This oscillating portion has a cavity 5 in which there is received an additional mass 6, and by having additional masses of different densities it is possible to adjust the frequency of oscillation. Openings 7 and 7' make the projection 4 more flexible.

Figure 2:
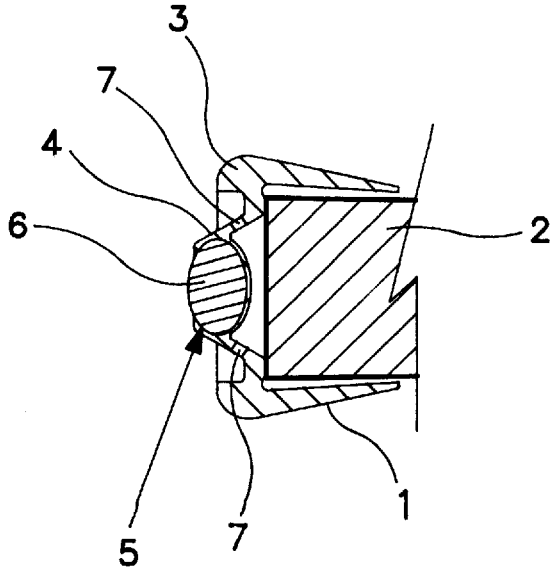
FIG. 2 is a section view through the end of the racket.

FIG. 2 is a longitudinal section view through the same device. It also shows the cap 1 surrounding the handle 2 of the racket, the ring 3 protecting the projection 4 that forms the oscillator, and the cavity 5, the additional mass 6, and the openings 7 and 7'.

Figure 3:
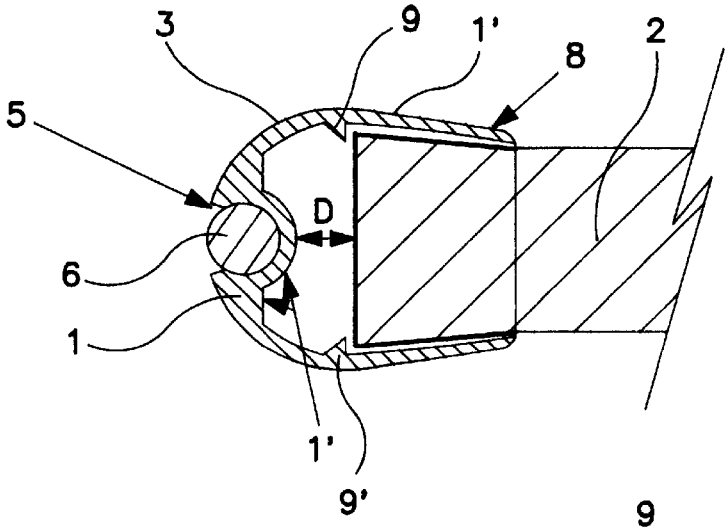
FIG. 3 shows another embodiment in which the device is removable.

FIG. 3 is a longitudinal section view of an antivibration device made of elastomer, and removably mounted on the end of a tennis racket handle. The device is made up of an element in the form of a cylindrical cap 1 whose rounded surface 1' is faired and receives the end 2 of the racket handle 3 to a certain depth. It will be observed that the portion 8 surrounding the handle is thin-walled so as to avoid impeding the hand of the player. Abutments 9 and 9' on a portion of the inside perimeter of the cap 1 prevent the end 2 of the racket handle advancing too far, thereby leaving an intermediate gap D that ensures flexibility for the portion 10 of the cap which is thus free to oscillate in all directions. The inside of the end wall 1*a* of the cap includes a spherical indentation 5 that opens to the outside for receiving a bead 6 of denser material.

Figure 4:
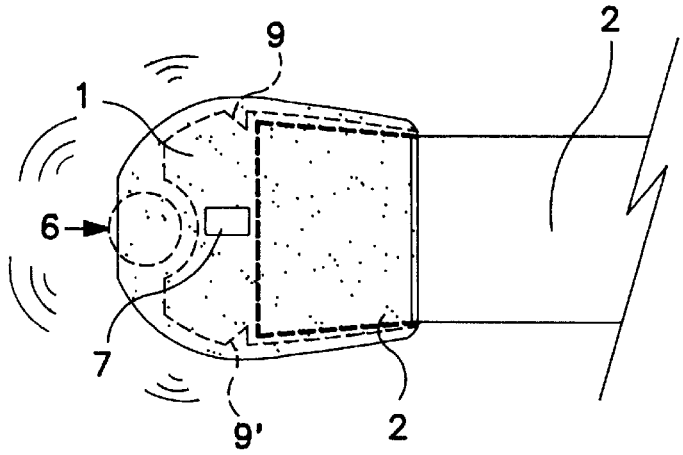
FIG. 4 is an outside view corresponding to FIG. 3.

FIG. 4 is an outside view of the same device 1 with the internal outline of the device, including its abutments 9 and 9' being shown in dashed lines, as is the end 2 of the racket handle. There can be seen the bead 6 for weighting the end of the cap 1, and the rounded fairing of the opening 7 through the wall of the cap 1 enabling air to escape while the cap is being installed on the racket handle 2.

Figure 5:
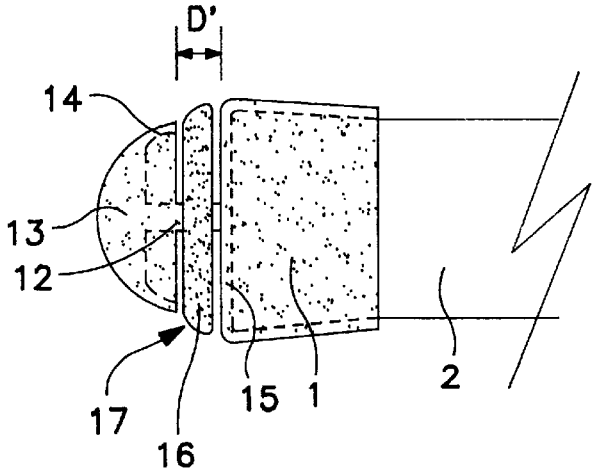
FIG. 5 shows a variant embodiment.

FIG. 5 shows a variant of the invention constituted by a cylindrical cap 1 that is fully engaged on the handle 2 of a racket. The cap is provided with an oscillating portion 12 whose hemispherical endpiece 13 constitutes a rounded and faired extension 14 of the cap with an opening directed towards the flat end wall 15 of the cylindrical cap 1. A washer 16, made of foam in this case, and itself including a rounded portion 17, is interposed in the gap D' to surround the damper assembly and ensure that it presents no portions that might catch on the clothing of the player during play.

Naturally, the embodiments of the invention are given purely by way of example and variant shapes of the component elements, in particular of the cap and the oscillator would not go beyond the ambit of the invention.

I claim:

1. A tennis racquet with a vibration damping device, comprising:

the tennis racquet having a strung surface and a handle, the vibration damping device being incorporated with the handle, the vibration damping device comprising a flexible cap and an oscillating mass, the cap being mounted on a free end of the handle, wherein the oscillating mass is contained in a cavity formed in a wall of the cap at a distance from the free end of the handle, while remaining connected to the handle.

2. The racquet according to claim 1 wherein the oscillating mass is integrally molded in the cap.

3. The racquet according to claim 1 wherein the cavity containing the oscillating mass if formed in a projection of the cap.

4. A tennis racquet with a vibration damping device, comprising:

the tennis racquet having a strung surface and a handle, the vibration damping device being incorporated with the handle, the vibration damping device comprising a flexible cap and an oscillating mass, the cap being mounted on a free end of the handle, wherein the oscillating mass is contained in a cavity formed in a wall of the cap at a distance from the free end of the handle, while remaining connected to the handle;

wherein the cavity containing the oscillating mass is formed in a projection of the cap; and, wherein the projection has at least one axial opening.

5. A tennis racquet with a vibration damping device, comprising:

the tennis racquet having a strung surface and a handle, the vibration damping device being incorporated with the handle, the vibration damping device comprising a flexible cap and an oscillating mass, the cap being mounted on a free end of the handle, wherein the oscillating mass is contained in a cavity formed in a wall of the cap at a distance from the free end of the handle, while remaining connected to the handle; and, wherein the cap is removably mounted on the free end of the handle, the cap receiving the handle to some extent only and including an opening to allow air to escape.

6. The racquet according to claim 5 wherein the cap has an inside surface with at least one abutment against which an outside surface of the handle bears.

7. A vibration damping device for a racquet having a handle, comprising:

a flexible cap dimensioned for mounting on a free end of said handle, the cap having an oscillating mass, wherein said oscillating mass is contained in a cavity formed in a wall of said cap, the cavity being placed such that when said vibration damping device is mounted to said free end, said oscillating mass is positioned at a distance from said free end while remaining connected thereto.

8. The vibration damping device according to claim 7 wherein the oscillating mass is integrally molded in the cap.

9. The vibration damping device according to claim 7 wherein the cavity containing the oscillating mass is formed in a projection of the cap.

10. The vibration damping device according to claim 9 wherein the projection has at least one axial opening.

11. A vibration damping device for a racquet having a handle, comprising:

a flexible cap dimensioned for mounting on a free end of said handle the cap having an oscillating mass, wherein said oscillating mass is contained in a cavity formed in a wall of said cap, the cavity being placed such that when said vibration damping device is mounted to said free end, said oscillating mass is positioned at a distance from said free end while remaining connected thereto;

wherein the cap is removably mountable on the end of the handle, the cap being structured to receive the handle to some extent only and including an opening to allow air to escape.

12. The vibration damping device according to claim 11 wherein the cap has an inside surface with at least one abutment for bearing against an outside surface of the handle.

13. A vibration damping device for a handle, comprising:

a flexible cap dimensioned for mounting on an end of said handle, the cap containing an oscillating mass in a cavity in a wall of said cap, the cavity being placed to position said oscillating mass at a distance from said end, and wherein the wall defines at least one opening into the cavity containing the oscillating mass.

* * * * *